US010839640B2

(12) United States Patent
Hendricks et al.

(10) Patent No.: US 10,839,640 B2
(45) **Date of Patent: *Nov. 17, 2020**

(54) GAMING SYSTEM AND METHOD OF GAMING WITH SYMBOL PRESENTATION THAT MIMICS A GRAPHIC EQUALIZER

(71) Applicant: Aristocrat Technologies Australia Pty Limited, North Ryde (AU)

(72) Inventors: Bradley Hendricks, Las Vegas, NV (US); Britta Nauta-Larsen, Las Vegas, NV (US); Alex Gansert, Las Vegas, NV (US); Francis Styck, Henderson, NV (US)

(73) Assignee: ARISTOCRAT TECHNOLOGIES AUSTRALIA PTY LIMITED, North Ryde (AU)

( * ) Notice: Subject to any disclaimer, the term of this patent is extended or adjusted under 35 U.S.C. 154(b) by 0 days.

This patent is subject to a terminal disclaimer.

(21) Appl. No.: 16/531,699

(22) Filed: Aug. 5, 2019

(65) Prior Publication Data

US 2019/0355208 A1 Nov. 21, 2019

Related U.S. Application Data

(63) Continuation of application No. 14/867,688, filed on Sep. 28, 2015, now Pat. No. 10,380,830.

(30) Foreign Application Priority Data

Sep. 29, 2014 (AU) ..... 2014903867

(51) Int. Cl.
*G07F 17/32* (2006.01)
*G07F 17/42* (2006.01)

(52) U.S. Cl.
CPC ..... *G07F 17/3213* (2013.01); *G07F 17/3209* (2013.01); *G07F 17/3246* (2013.01); *G07F 17/42* (2013.01)

(58) Field of Classification Search
CPC ..... G07F 17/3213; G07F 17/3209; G07F 17/3246; G07F 17/42; G07F 17/3269; G06F 3/162
See application file for complete search history.

(56) References Cited

U.S. PATENT DOCUMENTS

2014/0087878 A1 3/2014 Basallo et al.
2015/0161853 A1 6/2015 Ryan

OTHER PUBLICATIONS

Australian Examination Report No. 1 for Application No. AU2018278982, dated Feb. 26, 2020, 3 pages.

*Primary Examiner* — Werner G Garner
(74) *Attorney, Agent, or Firm* — McAndrews, Held & Malloy, Ltd.

(57) ABSTRACT

A gaming machine having at least a first and a second display located adjacent each other, and at least one speaker, a symbol selector selects symbols for positioning in respective ones of a plurality of first and second symbol positions, said first symbol positions being displayed in a gaming area of said first display; an outcome evaluator monitors said selection and determines when a trigger condition is satisfied; in response to said trigger condition being satisfied, triggers an event in which said controller selects: 1) one of a plurality of music tracks to be played through said speaker, each music track having at least one characteristic; and 2) a number of second symbol positions to be displayed on said second display; wherein the number of second symbol positions selected for display on said second display is determined at least in part by said at least one characteristic.

20 Claims, 8 Drawing Sheets

GAMING SYSTEM AND METHOD OF GAMING WITH SYMBOL PRESENTATION THAT MIMICS A GRAPHIC EQUALIZER

RELATED APPLICATIONS

This application is a continuation of U.S. patent application Ser. No. 14/867,688, filed Sep. 28, 2015, which claims priority to Australia Provisional Patent Application No. 2014903867, filed Sep. 29, 2014, both of which are incorporated herein by reference in their entireties.

BACKGROUND OF THE INVENTION

In existing gaming systems, feature games may be triggered for players in addition to the base game. A feature game gives players an additional opportunity to win prizes, or the opportunity to win larger prizes, than would otherwise be available in the base game. Feature games can also offer altered game play to enhance player enjoyment.

While such gaming systems provide players with enjoyment, a need exists for alternative methods to provide feature games in gaming systems, and for a larger variety of types of feature games, in order to maintain or increase player enjoyment.

BRIEF SUMMARY OF THE INVENTION

According to one aspect of the invention there is provided a gaming machine having at least a first and a second display located adjacent each other, and at least one speaker, said gaming machine comprising:

a symbol selector for selecting a plurality of symbols for positioning in respective ones of a plurality of first and second symbol positions, wherein said first symbol positions are displayed in a gaming area of said first display;

an outcome evaluator for monitoring said selection and determining when at least one trigger condition is satisfied;

in response to said trigger condition being satisfied, triggering an event in which said controller is configured to select:

1) one of a plurality of music tracks to be played through said speaker, each music track having at least one characteristic; and
2) a number of second symbol positions to be displayed on said second display;

wherein the number of second symbol positions selected for display on said second display is determined at least in part by said at least one characteristic.

In one embodiment, the number of second symbol positions selected for display on the second display is repeatedly randomly determined. In such embodiments, the number of second symbol positions that are displayed on the second display is updated each time the number of second symbol positions is determined to thereby mimic a graphic equalizer on the second display.

In one embodiment, the repeated determining of the number of second symbol positions continues in tempo with the music track, and stops when play of the music track stops. In this or other embodiments, play of the music track stops randomly.

In one embodiment, the second symbol positions are displayed on the second display adjacent to the plurality of first symbol positions on the first display such that the first and second symbol positions together define an expanded gaming area.

In one embodiment, the outcome evaluator determines outcomes based on symbols selected for display in the expanded gaming area. Outcomes in such embodiments are determined based on at least one of a plurality of predefined symbol combinations.

In one embodiment, the at least one characteristic of the music track is selected from the group: beat, artist, length of track, country of origin, style, label, and recording studio.

According to another aspect of the invention there is provided a gaming machine including a primary display having at least a first display portion and a second display portion located adjacent each other, and further including at least one speaker, said gaming machine comprising:

a symbol selector for selecting a plurality of symbols for positioning in respective ones of a plurality of first and second symbol positions, wherein said first symbol positions are displayed in a gaming area of said first display portion;

an outcome evaluator for monitoring said selection and determining when at least one trigger condition is satisfied;

in response to said trigger condition being satisfied, triggering an event in which said controller is configured to select:

1) one of a plurality of music tracks to be played through said speaker, each music track having at least one characteristic; and
2) a number of second symbol positions to be displayed on said second display portion;

wherein the number of second symbol positions selected for display on said second display portion is determined at least in part by said at least one characteristic.

According to another aspect of the invention there is provided a method of gaming on a gaming machine having at least a first and a second display located adjacent each other, and at least one speaker, said gaming machine comprising:

selecting using a symbol selector a plurality of symbols for positioning in respective ones of a plurality of first and second symbol positions, wherein said first symbol positions are displayed in a gaming area of said first display;

monitoring using an outcome evaluator said selection and determining when at least one trigger condition is satisfied;

in response to said trigger condition being satisfied, triggering an event in which said controller is configured to select:

1) one of a plurality of music tracks to be played through said speaker, each music track having at least one characteristic; and
2) a number of second symbol positions to be displayed on said second display;

wherein the number of second symbol positions selected for display on said second display is determined at least in part by said at least one characteristic.

According to another aspect of the invention there is provided a method of gaming on a gaming machine including a primary display having at least a first display portion and a second display portion located adjacent each other, and further including at least one speaker, said gaming machine comprising:

selecting using a symbol selector a plurality of symbols for positioning in respective ones of a plurality of first and second symbol positions, wherein said first symbol positions are displayed in a gaming area of said first display portion;

monitoring using an outcome evaluator said selection and determining when at least one trigger condition is satisfied;

in response to said trigger condition being satisfied, triggering an event in which said controller is configured to select:

1) one of a plurality of music tracks to be played through said speaker, each music track having at least one characteristic; and
2) a number of second symbol positions to be displayed on said second display portion;

wherein the number of second symbol positions selected for display on said second display portion is determined at least in part by said at least one characteristic.

According to another aspect of the invention there is provided a computer program code which when executed by components of a controller of a gaming system implements the above method.

According to another aspect of the invention there is provided a tangible computer readable medium comprising the above computer program code.

BRIEF DESCRIPTION OF SEVERAL VIEWS OF THE DRAWINGS

Features and advantages of certain embodiments of the present invention will become apparent from the following description of embodiments thereof, by way of example only, with reference to the accompanying drawings, in which.

Figure 1:
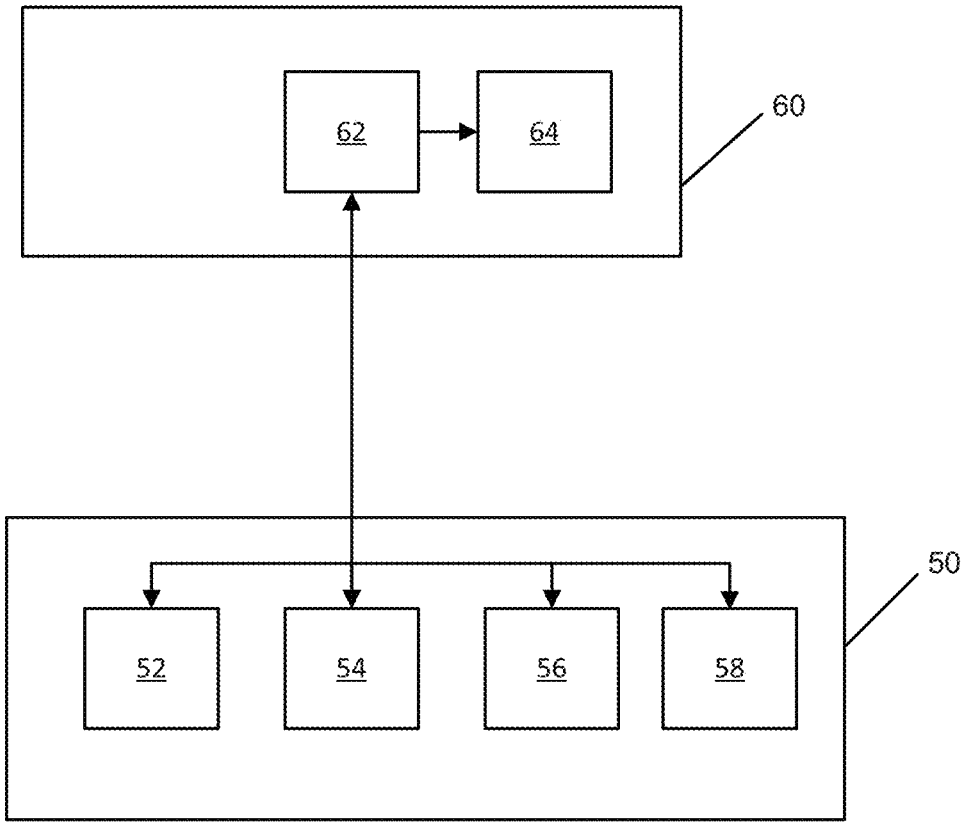
FIG. 1 is a block diagram of the core components of a gaming system.

The foregoing summary, as well as the following detailed description of certain embodiments of the present invention, will be better understood when read in conjunction with the appended drawings. For the purpose of illustrating the invention, certain embodiments are shown in the drawings. It should be understood, however, that the present invention is not limited to the arrangements and instrumentality shown in the attached drawings.

DETAILED DESCRIPTION OF THE INVENTION

Referring to the drawings, there are shown example embodiments of gaming systems which have components arranged to implement a base game, from which may be triggered a feature game. In the feature game, a game area on the display is caused to expand so that additional symbols may be displayed in a game area of the display. In an embodiment, a music track is selected for play through the speakers when the game area is to be expanded, and expansion of the game area occurs in tempo with the music track. The invention is not limited to expanding the game area in only a feature game in tempo with a music track, however. In other embodiments, the game area may be expanded in any part of the game based on any characteristic of a sound file.

General Construction of Gaming System

The gaming system can take a number of different forms. In a first form, a stand alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Irrespective of the form, the gaming system 1 has several core components. At the broadest level, the core components are a player interface 50 and a game controller 60 as illustrated in FIG. 1. The player interface is arranged to enable manual interaction between a player and the gaming system and for this purpose includes the input/output components required for the player to enter instructions to play the game and observe the game outcomes.

Components of the player interface may vary from embodiment to embodiment but will typically include a credit mechanism 52 to enable a player to input credits and receive payouts, one or more displays 54, a game play mechanism 56 including one or more input devices that enable a player to input game play instructions (e.g. to place a wager), and one or more speakers 58.

The game controller 60 is in data communication with the player interface and typically includes a processor 62 that processes the game play instructions in accordance with game play rules and outputs game play outcomes to the display. Typically, the game play rules are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server. That is a processor may be provided by any suitable logic circuitry for receiving inputs, processing them in accordance with instructions stored in memory and generating outputs (for example on the display). Such processors are sometimes also referred to as central processing units (CPUs). Most processors are general purpose units, however, it is also know to provide a specific purpose processor using an application specific integrated circuit (ASIC) or a field programmable gate array (FPGA).

Figure 2:
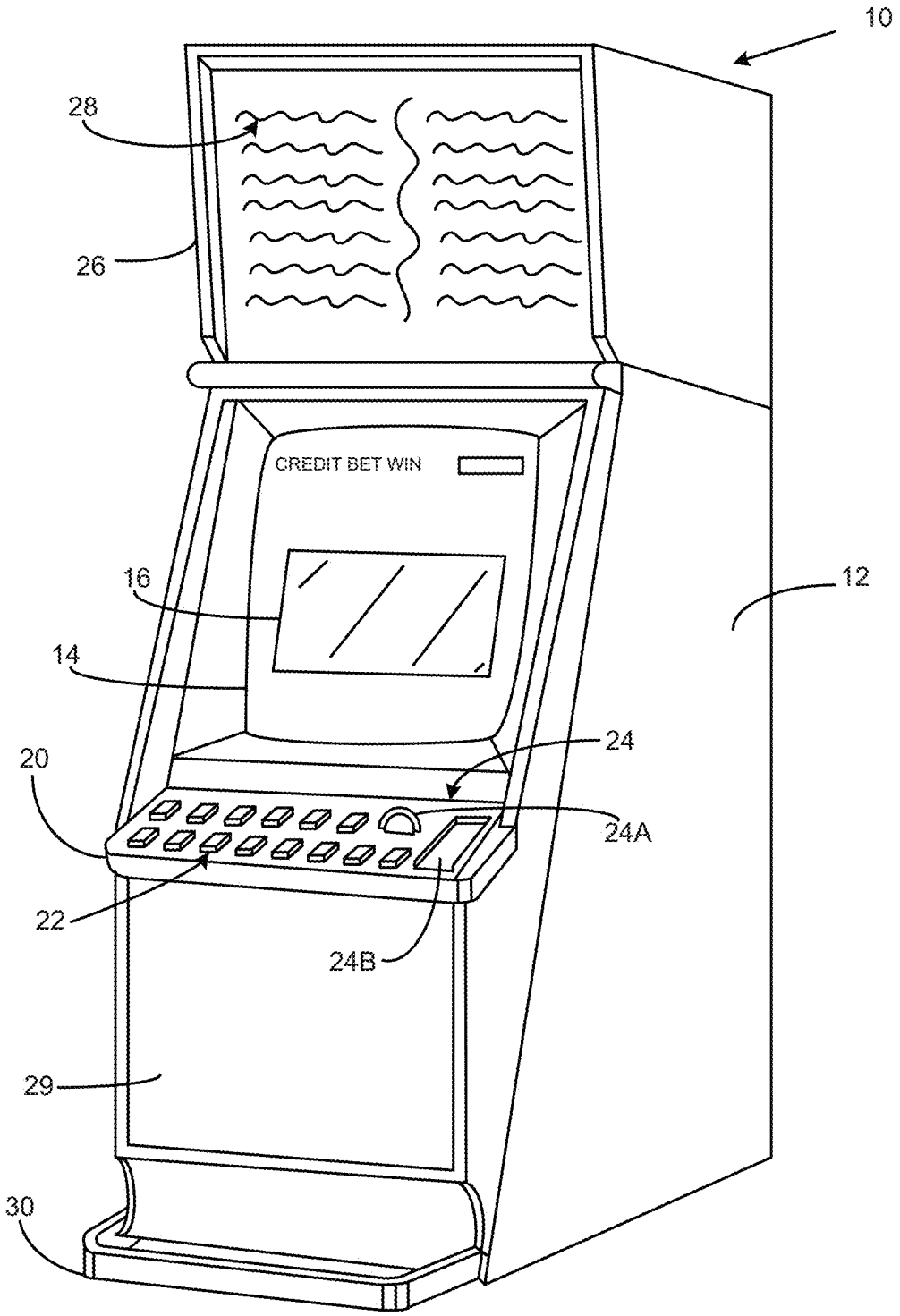
FIG. 2 is a perspective view of a stand alone gaming machine.

A gaming system in the form of a stand alone gaming machine 10 is illustrated in FIG. 2. The gaming machine 10 includes a console 12 having a display 14 on which are displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. Other gaming machines may configure for ticket in such that they have a ticket reader for reading tickets having a value and crediting the player based on the face value of the ticker. A player marketing module (not shown) having a reading device may also be provided for the purpose of reading a player tracking device, for example as part of a loyalty program. The player tracking device may be in the form of a card, flash drive or any other portable storage medium capable of being read by the reading device. In some embodiments, the player marketing module may provide an additional credit mechanism, either by transferring credits to the gaming machine from credits stored on the player tracking device or by transferring credits from a player account in data communication with the player marketing module.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

Figure 3:
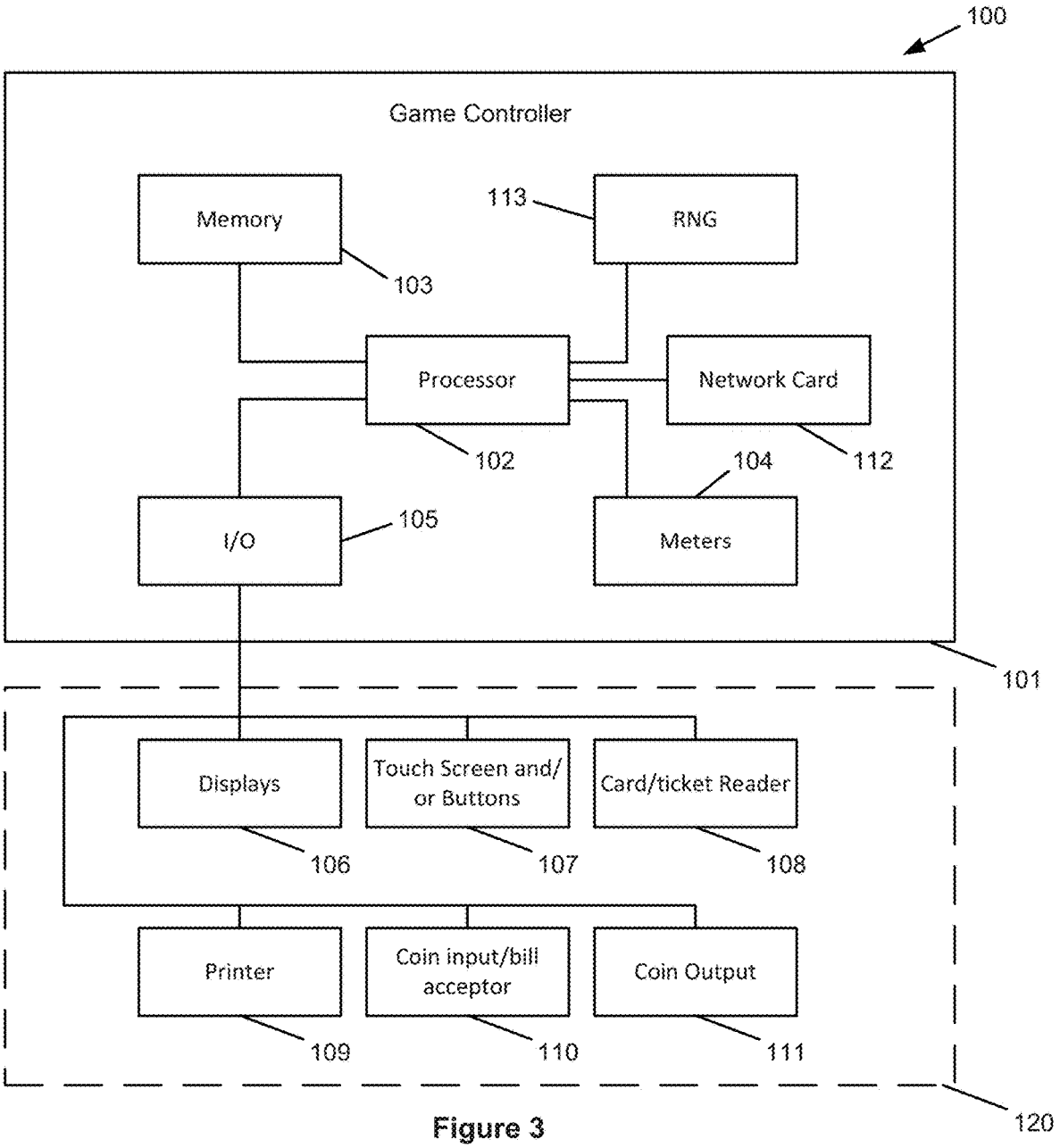
FIG. 3 is a block diagram of the functional components of a gaming machine.

FIG. 3 shows a block diagram of operative components of a typical gaming machine which may be the same as or different to the gaming machine of FIG. 2.

The gaming machine 10 includes a game controller 101 having a processor 102 mounted on a circuit board. Instructions and data to control operation of the processor 102 are stored in a memory 103, which is in data communication with the processor 102. Typically, the gaming machine 10 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 including one or more displays 106, a touch screen and/or buttons 107 (which provide a game play mechanism), a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation. For example, while buttons or touch screens are typically used in gaming machines to allow a player to place a wager and initiate a play of a game any input device that enables the player to input game play instructions may be used. For example, in some gaming machines a mechanical handle is used to initiate a play of the game. Persons skilled in the art will also appreciate that a touch screen can be used to emulate other input devices, for example, a touch screen can display virtual buttons which a player can "press" by touching the screen where they are displayed.

In addition, the gaming machine 100 may include a communications interface, for example a network card 112. The network card may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of the gaming machine.

Figure 4:
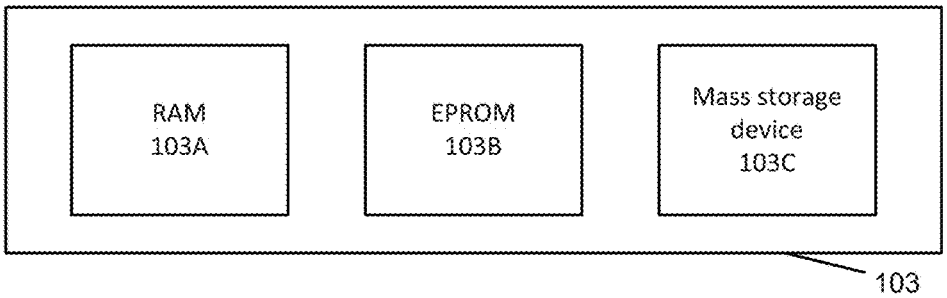
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106,107,108,109,110,111 to be provided remotely from the game controller 101.

Figure 5:
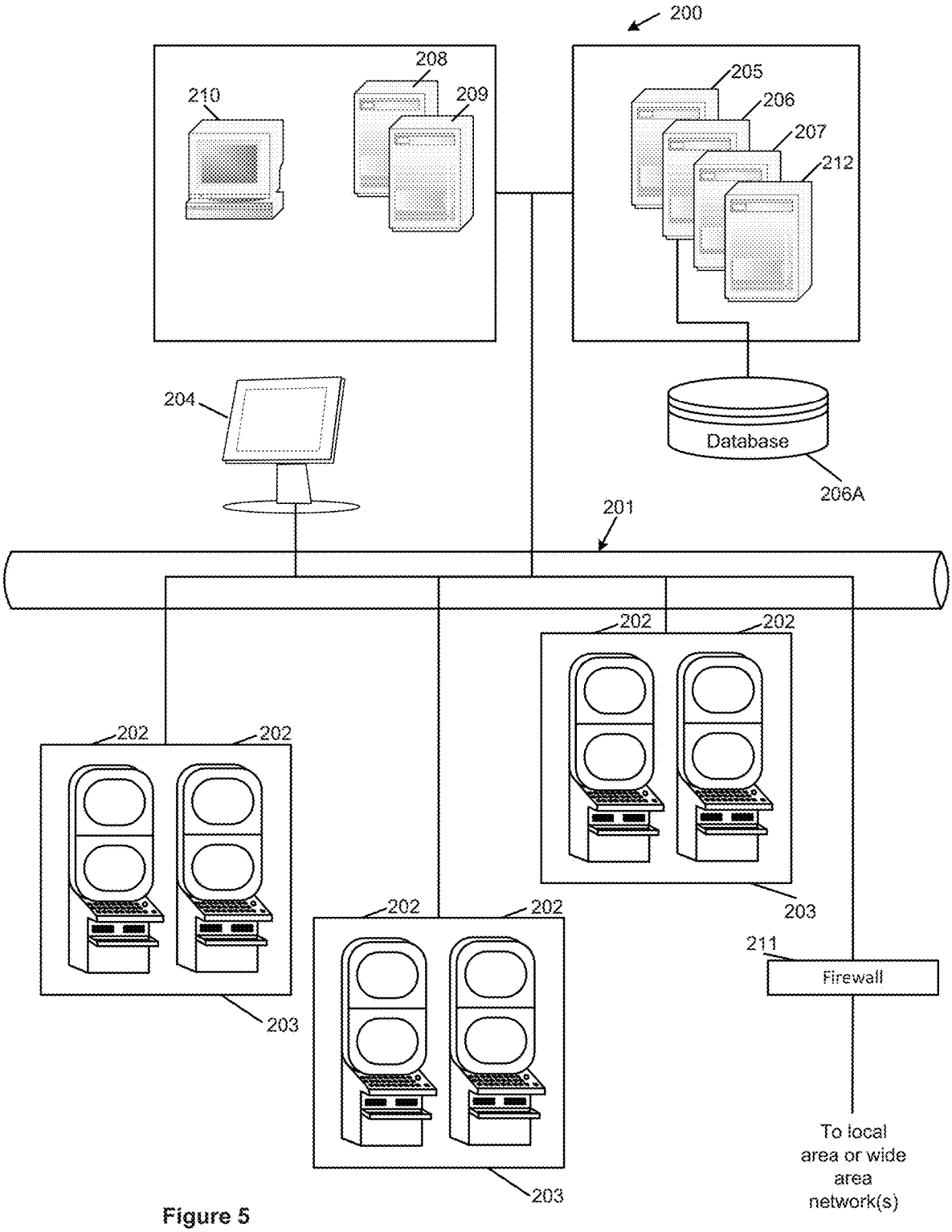
FIG. 5 is a schematic diagram of a network gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5 are connected to the network 201. The gaming machines 202 provide a player operable interface and may be the same as the gaming machines 10, 100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games as required by the terminals.

Further Detail of Gaming System

The player operates the game play mechanism 56 to specify a wager and hence the win entitlement which will be evaluated for this play of the game and initiates a play of the game. Persons skilled in the art will appreciate that a player's win entitlement will vary from game to game dependent on player selections. In most spinning reel games, it is typical for the player's entitlement to be affected by the amount they wager and selections they make (i.e. the nature of the wager). For example, a player's win entitlement may be based on how many lines they play in each game—e.g. a minimum of one line up to the maximum number of lines allowed by the game (noting that not all permutations of win lines may be available for selection) and how much they wager per line. Such win lines are typically formed by a combination of symbol positions, one from each reel, the symbol positions being located relative to one another such that they form a line.

In many games, the player's win entitlement is not strictly limited to the lines they have selected, for example, "scatter" pays are awarded independently of a player's selection of paylines and are an inherent part of the win entitlement.

Persons skilled in the art will appreciate that in other embodiments, the player may obtain a win entitlement by selecting a number of reels to play and an amount to wager. Such games are marketed under the trade name "Reel Power" by Aristocrat Leisure Industries Pty Ltd. The selection of the reel means that each displayed symbol of the reel can be substituted for a symbol at one or more designated symbol positions. In other words, all symbols displayed at symbol positions corresponding to a selected reel can be used to form symbol combinations with symbols displayed at a designated, symbol positions of the other reels. For example, if there are five reels and three symbol positions for each reel such that the symbol positions comprise three rows of five symbol positions, the symbols displayed in the centre row are used for non-selected reels. As a result, the total number of ways to win is determined by multiplying the number of active symbol positions of each reel, the active symbol positions being all symbol positions of each selected reel and the designated symbol position of the non-selected reels. As a result for five reels and fifteen symbol positions there are 243 ways to win.

Figure 6:
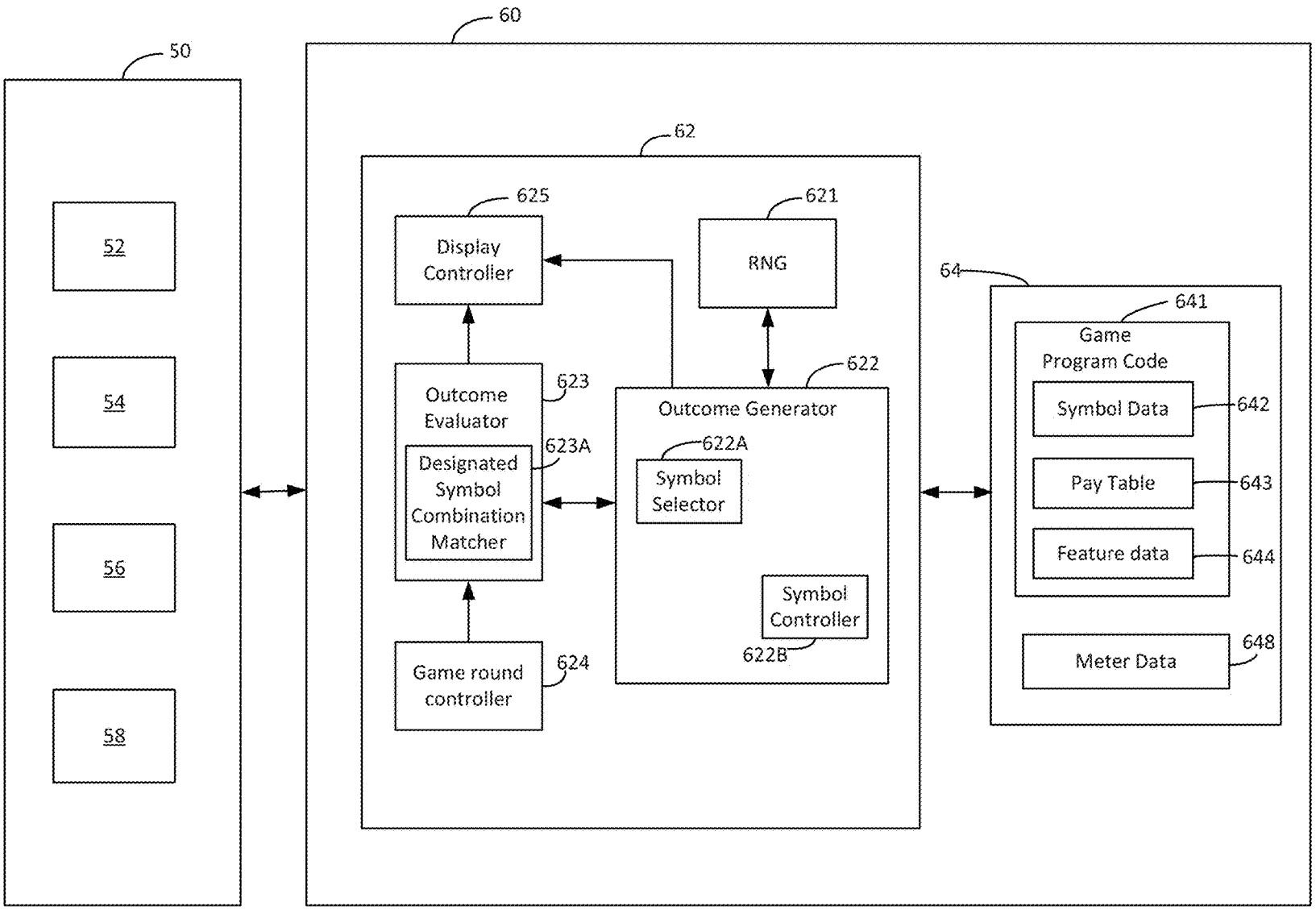
FIG. 6 is a further block diagram of a gaming system.

In FIG. 6, the processor 62 of game controller 60 of gaming system 1 is shown implementing a number of modules based on game program code 641 stored in memory 64. Persons skilled in the art will appreciate that various of the modules could be implemented in some other way, for example by a dedicated circuit.

These modules include the outcome generator 622 which operates in response to the player's operation of game play mechanism 56 to place a wager and initiate a play of the game and generates a game outcome which will then be evaluated by outcome evaluator 623. The first part of forming the game outcome is for a symbol selector 622A to select symbols from a set of symbols specified by symbol data 642 using random number generator 621. The selected symbols are advised to the display controller 625 which causes them to be displayed as a symbol display on display 54 at a set of symbol positions.

In the embodiment described below, the symbol positions of the symbol display are arranged in a rectangular matrix comprising a plurality of columns and a plurality of rows. However, in other arrangements as known in the gaming industry could be employed in embodiments of the invention. For example, in some arrangements there are more symbols in some columns than other, such as 3-4-3-4-3 arrangement of seventeen symbol positions corresponding to respective ones of five reels. In such arrangements, the columns of four symbols can be arranged so that they are off-set or staggered relative to the columns having two symbols so that the middle two symbols in the columns of four symbols share boundaries with two symbols of each neighbouring reel.

Figure 7:
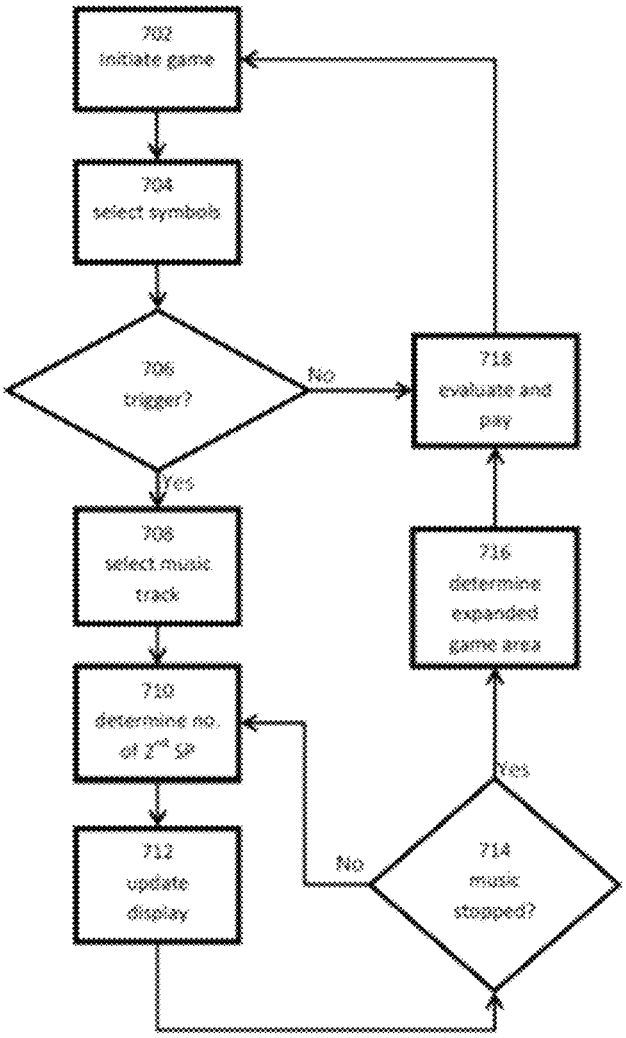
FIG. 7 is a flow diagram of a feature game.

FIG. 7 shows a flow diagram of one embodiment, in which a game area may be expanded during play of a game. In this embodiment, a game area comprises a plurality of columns, each made up of a plurality of first or second symbol positions. A base game is initiated at step 702, from which a feature game may be triggered by any method known to those skilled in the art. Triggering mechanisms are not discussed further herein.

Figure 8:
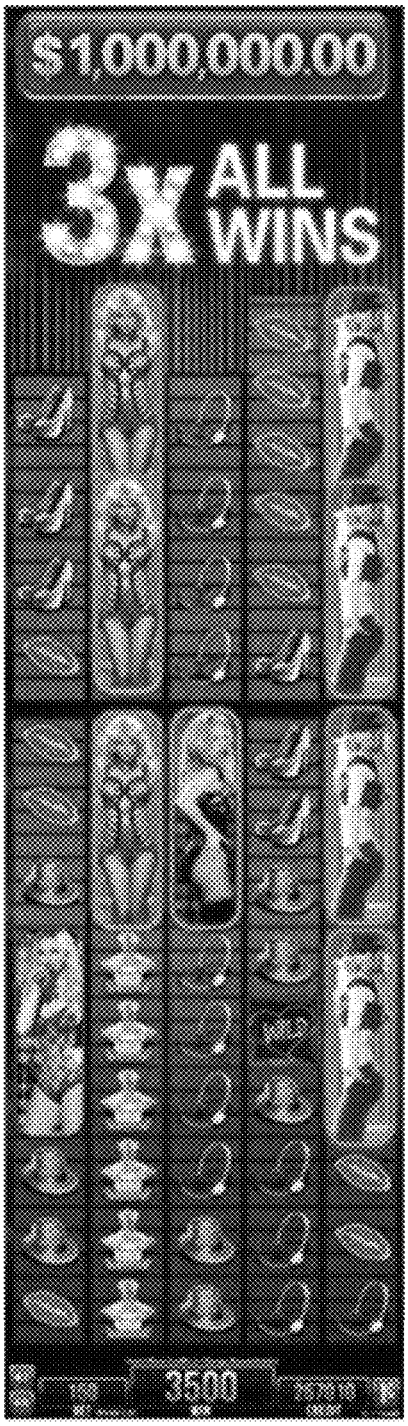
FIG. 8 is a screen shot of an example of the invention.

Starting at step 704, symbol selector 622A selects symbols from symbol data 642 for positioning in first symbol positions 802 and second symbol positions 804, as best shown in FIG. 8. Further, in the FIG. 8 embodiment, first symbol positions 802 are displayed on first display 806 while second symbol positions 804 are displayed on second display 808. As shown, first and second displays in this embodiment are aligned vertically. In other embodiments, there may only be a single display that is divided into 2 portions or more, wherein the first symbol positions are displayed on the first display portion and the second symbols positions are displayed on the second display portion. Furthermore, in other embodiments, the first and second displays, or the first and second display portions, may be aligned horizontally.

In this embodiment, only first symbol positions 806 are active during play of the base game, while the second symbol positions are only activated during play of the second game. Thus during play of the base game, the game area comprises only the first symbol positions and is displayed only in the first display. In this or other embodiments, during play of the base game, the second display may therefore be dedicated to other graphics such as jackpot details, game rules, pay tables or the like which will be known to those skilled in the art.

In this embodiment, symbol selector 622A selects symbols for positioning in both first and second symbol positions 806 and 808 simultaneously; notwithstanding that second symbol positions 808 are not displayed in the base game. In other embodiments, symbol selector 622A is configured to only select symbols for positioning in symbol positions that are displayed. For example, during the base game, symbols are only selected for positioning in the first symbol positions 806. In feature games, symbols are then selected for positioning in both first and second symbol positions 806 and 808.

Once symbols are selected for positioning in first and second symbol positions 806 and 808, outcome evaluator 623 determines whether a trigger condition is satisfied at step 706. In one embodiment, the game area expansion feature is triggered when a predefined number of scatter symbols are selected for display in the game area. In other embodiments, the expansion feature is triggered randomly during play of the base game. In general, triggering mechanisms are known in the art and are not discussed further herein.

If the trigger condition is not satisfied at step 706, the game area is evaluated by outcome evaluator 623, and any awards are paid at step 718. Note that in this embodiment, if a feature game is not triggered, awards are evaluated based on symbols selected for positioning in the first symbol positions on the first display only.

If the feature is triggered at step 706, a music track is selected for play at step 708. In this embodiment, the music track is select by feature controller 622B, which controls all aspects of the feature game. Feature controller 622B selects a music track from feature data 644, which is played through speakers 58 in accompaniment to play of the feature game. Feature data 644 in this embodiment comprises inter alia, a plurality of music tracks, in the form of popular songs by one or more contemporary artists. In other embodiments, feature data 644 may comprise classical music, opera, or any other sound file from which feature controller 622B may select accompanying music.

When the selected music track starts, feature controller 622B at step 710 determines a number of second symbol positions to be displayed on the second display 808. In this embodiment, the number of second symbol positions is selected randomly, for example through use of the RNG 621. In other embodiments, the number of second symbol positions is predefined to match a desired pattern or sequence, and stored as part of feature data 644. Feature controller 622B then selects the appropriate predefined number of second symbol positions to display on the second display from feature data 644.

Once the number of second symbol positions is determined, feature controller 622B sends a message to display controller 625 to update second display 808, at step 712, with the number of second symbol positions to display. As noted, in this embodiment second symbol positions are displayed on the second display and are only displayed during the feature game. The second symbol positions are displayed on the second display adjacent to the first symbol positions so that the first and second symbol positions form a contiguous game area and effectually expand the game area. In this embodiment, as noted above, second symbol positions are pre-populated by symbol selector 622A when they are displayed on the second display. Game outcomes are then determined by outcome evaluator 623 based on this expanded game area comprised of first and second symbol positions.

At step 714, feature controller 622B determines whether the selected music track has stopped. In some embodiments, this includes determining randomly whether the music track is to stop, for example randomly using RNG 621. In some embodiments, play of the music track may have a predefined maximum time limit, and the track may be stopped randomly by feature controller 622B at any time before this predefined maximum time limit. In other embodiments, there may also be a predefined minimum limit, during which play of the music track cannot be stopped. Such an embodiment ensures that the feature will last at least as long as the predefined minimum limit.

While the music track is playing, that is, while function controller 622B determines that the music track has not stopped at step 714, function controller 622B once again determines a number of second symbol positions by returning control to step 710. Second display 808 is then updated accordingly at step 712, following the number of second symbol positions being determined. Steps 710 and 712 continue repeatedly while the selected music track continues to play, each time randomly determining a number of second symbol positions and updating the second display with the randomly determined number, such that the game area expands and contracts while the music track is playing and the player cannot determine how big the expanded game area will grow to.

In one embodiment, a single number of second symbol positions 808 is randomly determined, and this single number is applied to all the columns comprising the game area so that the columns increase or decrease by the same amount each time the second display is updated. In other embodiments, different numbers of second display positions 808 are determined for each column making up the game area. In such an embodiment, each column expands or contracts by a larger or smaller amount during play of the music track, thereby emulating the display of a graphic equaliser.

When, at step 714, function controller 622B determines that the music track has stopped, the function controller determines the exact size of the expanded game area at step 714. Referring specifically to the equaliser embodiment discussed above, the expanded game area will comprise a plurality of columns each comprised of a predefined number of first symbol positions 806 and a different number of second symbol positions 808 as determined at step 710. This is best shown in FIG. 8.

In one embodiment, awards are paid according to a predefined pay table 643, which defines the magnitude and/or the nature of the award according to combinations formed by symbols selected for display in the first and second symbol positions 806 and 808. Once paid, the game ends and control returns to step 702.

Example 1

More specific examples of embodiments of the invention are now described with reference to FIGS. 8 and 9. As shown in these Figures, the game is implemented using a first display 806 and a second display 808 vertically aligned with each other. Of course, the game is not limited to being implemented using vertically aligned displays, and displays may be aligned in other ways, for example horizontally. As noted above, the symbol positions located in first display 806 are labelled first symbol positions 802, while symbol positions located in second display 808 are labelled second symbol positions 804.

FIG. 8 shows the base game, game area on first display 806, which is comprised solely of first display positions 802. In this example of the feature game, the number of second symbol positions 804 is randomly determined repeatedly for each individual column while a music track is playing, causing each column 810 on second display 808 to rise and fall, mimicking the display of a graphic equaliser. When the music track stops, second display 808 pauses causing the last determined number of second symbol positions 804 to remain on second display 804. As shown in FIG. 8, when the music stopped, columns 1 and 3 are comprised of 4 second symbol positions while columns 2, 4 and 5 are comprised of 5 second symbol positions 804.

Once the size of the expanded game area is determined, function controller 622B evaluates the symbols selected in the displayed first and second symbol positions 802 and 804 and pays any available prizes with reference to pay table 643. In this embodiment, prizes are predefined on the pay table and awarded on the basis of winning combinations. That is, the player is awarded a prize if a predefined winning combination is formed from the symbols displayed in the first and second symbol positions on the first and second displays.

Example 2

Figure 9:
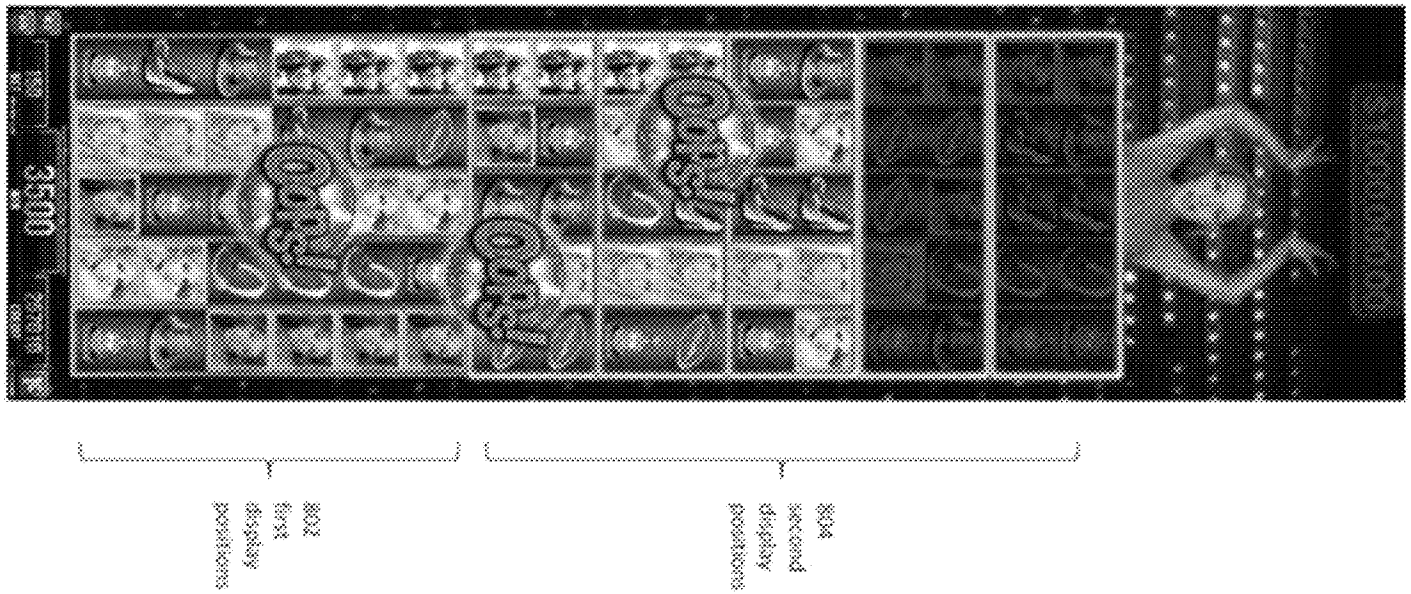
FIG. 9 is a screen shot of another example of the invention.

FIG. 9 shows the base game, game area on first display 806, which is comprised solely of first display positions 802. In this example of the feature game, the number of second symbol positions 804 is randomly determined repeatedly for all the columns collectively while a music track is playing, causing the columns 810 on second display 808 to rise and fall together in a block. When the music track stops, second display 808 freezes causing the last determined number of second symbol positions 804 to remain on second display 804. As shown in FIG. 9, the columns 810 collectively rise or fall by 2 rows of symbol positions each time the display is updated.

In the embodiment of FIG. 9, a special "oops" symbol 902 is selected for display in the symbol positions, indicating to the player that an expansion (or contraction) of the game area is about to occur. In one embodiment, oops symbol 902 appears randomly in tempo with the selected music track, based on one or more predefined characteristics of the music track. In this embodiment, oops symbol 902 appears at random beats, although in other embodiments the special symbol may appears according to other characteristics such as at a predefined note or at random intervals calculated based on the length of the music track.

When feature controller 622B determines that the music track has stopped, it then determines the size of the expanded game area. Function controller 622B then evaluates the symbols selected in the displayed first and second symbol positions 802 and 804 and pays any available prizes with reference to pay table 643. In this embodiment, prizes are also predefined in the pay table and are also awarded on the basis of winning combinations.

As indicated above, the method may be embodied in program code. The program code could be supplied in a number of ways, for example on a tangible computer readable storage medium, such as a disc or a memory device, e.g. an EEPROM, (for example, that could replace part of memory 103) or as a data signal (for example, by transmitting it from a server). Further, different parts of the program code can be executed by different devices, for example in a client server relationship. Persons skilled in the art, will appreciate that program code provides a series of instructions executable by the processor.

It is to be understood that, if any prior art is referred to herein, such reference does not constitute an admission that the prior art forms a part of the common general knowledge in the art in any country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

What is claimed is:

1. A system, comprising:

a speaker;

one or more display devices; and a processor that executes instructions stored in a memory, wherein execution of the instructions causes the processor to at least:

play a music track through the speaker;

display a plurality of reels spinning on the one or more display devices in a game area comprising a plurality of symbol positions and a plurality of columns;

vary a height of one or more of the plurality of columns for at least part of a duration of spin of the plurality of reels based on at least one characteristic of the music track; and stop the plurality of reels and cease varying the height of the one or more of the plurality of columns to obtain an outcome comprising symbols in the plurality of columns.

2. The system of claim 1, wherein the execution of the instructions further causes the processor to display the varying height of the one or more of the plurality of columns concurrently for an entirety of the duration of spin of the plurality of reels.

3. The system of claim 1, wherein the at least one characteristic of the music track is a tempo of the music track.

4. The system of claim 1, wherein the execution of the instructions further causes the processor to vary the height of the one or more of the plurality of columns by varying a respective quantity of symbols displayed by each of the plurality of reels as the plurality of reels spin.

5. The system of claim 4, wherein the outcome is based on the respective quantity of symbols displayed by each of the plurality of reels after varying the height of the one or more of the plurality of columns has ceased.

6. The system of claim 1, wherein the execution of the instructions further causes the processor to vary the height of the one or more of the plurality of columns by varying a respective quantity of symbols displayed in an upper display of the one or more display devices as the music track plays through the speaker.

7. The system of claim 1, wherein stopping the plurality of reels is in response to stopping play of the music track.

8. A method, comprising:

playing a music track through a speaker of a computing device;

selecting, with a processor of the computing device, symbols from a set of symbols specified by symbol data stored in a memory of the computing device; and presenting the selected symbols at columns of symbol positions of one or more display devices of the computing device, wherein presenting the selected symbols comprises:

repeatedly updating the symbols in the columns of symbol positions and repeatedly varying a respective quantity of symbol positions in one or more of the columns as the music track plays through the speaker; and ceasing, updating the symbols and varying the respective quantity of symbol positions, to obtain an outcome comprising the symbols presented in the columns.

9. The method of claim 8, wherein updating the symbols comprises spinning a plurality of symbol carrying reels associated with the columns of symbol positions.

10. The method of claim 8, wherein varying the respective quantity of symbol positions comprises varying the respective quantity of symbol positions in tempo with the music track as the music track plays through the speaker.

11. The method of claim 8, wherein varying the respective quantity of symbol positions comprises varying the respective quantity of symbol positions per a predefined pattern as the music track plays through the speaker.

12. The method of claim 8, wherein varying the respective quantity of symbol positions comprises varying the respective quantity of symbol positions in an upper display device of the one or more display devices as the music track plays through the speaker.

13. The method of claim 8, wherein updating the symbols comprises spinning a plurality of reels that span across a plurality of display devices of the one or more display devices.

14. The method of claim 13, wherein varying the respective quantity of symbol positions comprises varying a respective quantity of symbol positions displayed by each of the plurality of reels as the plurality of reels spin.

15. A non-transitory computer readable storage medium comprising instructions, which when executed, cause a processor to:

play a music track through a speaker;

select and present symbols at symbol positions of one or more display devices;

cause the one or more display devices to mimic a graphic equalizer by repeatedly updating the symbols in the symbol positions and repeatedly varying a respective height of one or more columns of the symbol positions as the music track plays through the speaker;

stop play of the music track; and cease, in response to stopping play of the music track, updating the symbols in the symbol positions and varying the respective height of the one or more columns to obtain an outcome comprising the symbols in the columns.

16. The non-transitory computer readable storage medium of claim 15, wherein the instructions further cause the processor to vary the respective height of the one or more columns based on at least one characteristic of the music track.

17. The non-transitory computer readable storage medium of claim 15, wherein the instructions further cause the processor to vary the respective height of the one or more columns in tempo with the music track.

18. The non-transitory computer readable storage medium of claim 15, wherein the instructions further cause the processor to vary the respective height of the one or more columns per a predefined pattern.

19. The non-transitory computer readable storage medium of claim 15, wherein the instructions further cause the processor to vary the respective height of the one or more columns by varying a respective quantity of symbol positions displayed by the one or more columns.

20. The non-transitory computer readable storage medium of claim 15, wherein the instructions further cause the processor to update the symbols in the symbol positions by spinning a plurality of reels presented by the one or more display devices.

* * * * *